US005419256A

United States Patent [19]

Pollich

[11] Patent Number: 5,419,256

[45] Date of Patent: May 30, 1995

[54] DEVICE FOR LATERALLY ALIGNING SHEETS BEING FED INTO A PRINTING PRESS AND METHOD FOR ALIGNING THE SHEETS

[75] Inventor: Gerhard Pollich, Heidelberg, Germany

[73] Assignee: Heidelberger Druckmaschinen Aktiengesellschaft, Heidelberg, Germany

[21] Appl. No.: 168,526

[22] Filed: Dec. 15, 1993

[30] Foreign Application Priority Data

Dec. 17, 1992 [DE] Germany ..... 42 42 731.2

[51] Int. Cl.[6] ..... B41F 13/24; B65H 9/10

[52] U.S. Cl. ..... 101/485; 101/233; 271/236; 271/237

[58] Field of Search ..... 101/232, 233, 481, 485; 271/236, 237, 241, 250, 238, 231, 104, 195, 226, 248

[56] References Cited

U.S. PATENT DOCUMENTS

| | | | |
|---|---|---|---|
| 2,857,160 | 10/1958 | Vandeman | 271/237 |
| 2,857,161 | 10/1958 | Kist | 271/237 |
| 2,984,483 | 5/1961 | Kist | 271/237 |
| 3,388,905 | 6/1968 | Nash et al. | 271/237 |
| 4,060,237 | 11/1977 | Degen | 271/237 |
| 4,260,149 | 4/1981 | Melzer . | |
| 4,591,143 | 5/1986 | Jeschke | 271/236 |
| 4,635,925 | 1/1987 | Pollich | 271/237 |
| 4,882,988 | 11/1989 | Yamaguchi | 101/232 |
| 4,905,980 | 3/1990 | Nobile et al. | 101/233 |
| 5,263,699 | 11/1993 | Selak et al. | 271/236 |
| 5,294,108 | 3/1994 | Pollich et al. | 271/241 |

FOREIGN PATENT DOCUMENTS

| | | | |
|---|---|---|---|
| 0297220 | 1/1989 | European Pat. Off. . | |
| 2330484 | 1/1975 | Germany | 271/237 |
| 0135818 | 5/1979 | Germany | 271/236 |
| 3311197 | 10/1984 | Germany . | |
| 3716085 | 12/1988 | Germany . | |
| 0958282 | 9/1982 | U.S.S.R. | 271/236 |

OTHER PUBLICATIONS

"Copy Sheet Alignment by Shifting Rollers" IBM Technical Discl. Bulletin, vol. 22 No. 8A Jan./1980 pp. 3095–3096.

*Primary Examiner*—Eugene H. Eickholt
*Attorney, Agent, or Firm*—Nils H. Ljungman & Associates

[57] ABSTRACT

A device for laterally aligning sheets in a printing machine can have a feeding table via which the sheets are stream-fed to front lays, and a corresponding side-pull device for laterally moving the sheets after having been aligned at the front lays. The side-pull device can operate by admitting a suction to the sheets, and when moving heavy sheets, e.g. cardboard, at high machine speeds, a pull roller can supplement the suction air by pressing the sheets onto the side-pull device.

17 Claims, 4 Drawing Sheets

DEVICE FOR LATERALLY ALIGNING SHEETS BEING FED INTO A PRINTING PRESS AND METHOD FOR ALIGNING THE SHEETS

BACKGROUND OF THE INVENTION

1. Field of the Invention

The invention generally relates to a device for laterally aligning sheets being fed into a printing press. Such a device can typically have a feeding table, via which the sheets are fed, sheet-by-sheet to front lays, or stops, along with a corresponding side-pull device which can laterally move a respective sheet after the sheet is aligned at the front lay. Such a side-pull device typically will function by means of suction applied to the sheet.

2. Background Information

Known side-pull-type devices, such as those disclosed by German Patents DE 33 11 197 C2 (which corresponds to U.S. Pat. No. 4,591,143) or DE 37 16 085 A1, provide configurations in which the sheets are held by suction onto side-pull rails, or simply onto suction devices, followed by the sheets being conveyed into a respective lateral reference position by moving the side pull-type rails, or the suction devices, respectively. However, it has become apparent that, when aligning heavy sheet material, e.g. cardboard, the suction effect is not always sufficient to ensure an exact lateral movement of the sheet.

In general, the higher the machine speed, the shorter the time remaining for providing a lateral alignment. Moreover, with large sheet formats the mass to be moved is correspondingly larger, and thus considerable friction of the sheet on the feeding table must be overcome. Consequently, within the short time available it is generally not possible to bring such larger, or heavier sheets into the position which is called the reference position. If the frictional resistance between the pull rail and the sheet to be conveyed is increased by certain measures, there is the risk of damage to the sheet surface. As a consequence thereof, machine speeds generally have to be reduced in relation to the weight of the sheets to be printed. Thus, the overall output of the machine can be affected.

OBJECT OF THE INVENTION

In view of the above-indicated problems associated with known sheet-feeding devices, it is the object of the present invention to optimize the lateral alignment of the sheets, even for heavy sheets such as cardboard, at high machine speeds.

SUMMARY OF THE INVENTION

According to the present invention this object can be achieved by means of a side-pull device which has a side-pull rail to which suction is admitted, and also a pull roller which can press the sheet onto the side-pull rail. To move a sheet to be aligned, the pull roller can first be moved into contact with the sheet, and then following the contact of the pull roller with the sheet, the suction air can preferably be switched on. The sheet can then be moved laterally to a position against a side lay.

In accordance with the present invention, the side-pull device can also be configured to have a valve by means of which the suction effect can then be switched off, or simply reduced, after the device accelerates the sheet, but before the sheet abuts against the side lay. By means of the combination according to the present invention, when accelerating the sheet, the suction air can suction the sheet onto the pull-type rail and, at the same time, the pull roller can press the sheet onto the pull-type rail. Thus, in effect, a double holding force can be generated so that even heavy sheets can be pulled laterally, even at high machine speed. By switching off, or simply reducing the suction air after the acceleration process, a respective sheet can be reliably conveyed with a smaller holding force by means of the pull roller, so that the sheet may accurately abut against the side lay without a high contact force, as such high contact forces could cause damage to the sheet.

The device according to the present invention also provides the advantage that sheets of normal paper weight, instead of cardboard, can also be printed on the same printing machine. Thus, this solution according to the present invention does not limit the scope of use of the printing machine, and further, it can essentially also allow printing to be done at the given maximum speed of the printing machine, even when printing on heavier sheet stock, such as cardboard.

In an advantageous embodiment of the invention, the time necessary for admitting suction air to a respective sheet and/or the intensity of the suction effect can preferably be set according to the weight of the sheet to be processed. Thus, the press operator can have the ability to adjust, to the extent required, the conveying capacity corresponding to the paper weight. In so doing, unnecessary energy consumption can also essentially be avoided.

One aspect of the invention resides broadly in a printing press comprising a frame, a plate cylinder rotatably mounted on the frame, the plate cylinder having a longitudinal axis and a printing width along the longitudinal axis, a plurality of ink applicator rollers for being engaged with the plate cylinder and for applying ink to the plate cylinder, a plurality of inking rollers for applying ink to the plurality of ink applicator rollers, the plate cylinder having a printing width for accommodating ink, and the plurality of inking rollers having an inkable width corresponding to the printing width of the plate cylinder, apparatus for supplying ink to the plurality of inking rollers, and sheet feeding apparatus for feeding sheets of printing stock into said printing press. The sheet feeding apparatus comprising at least a first surface over which sheets are moved, which sheets have a first surface for being disposed adjacent the first surface of the sheet feeding means and a second surface opposite to the first surface. The printing press further comprises a device for moving sheets a first distance in a direction substantially parallel to the longitudinal axis of the plate cylinder to laterally align sheets with respect to the plate cylinder. The device for moving comprises a first device for engaging the first surface of sheets being fed, the first device having a portion for engaging the first surface of sheets being fed, and the portion for engaging being configured to move in the direction substantially parallel to the longitudinal axis of the plate cylinder, and the device for moving comprising a roller device for engaging the second surface of sheets being fed and pressing the first surface of sheets being fed into engagement with the portion of the first device for movement of sheets along with the portion of the first device.

Another aspect of the invention resides broadly in a sheet alignment device for aligning sheets of printing stock being fed into a printing press, the printing press having a frame, a plate cylinder rotatably mounted on the frame, the plate cylinder having a longitudinal axis and a printing width along the longitudinal axis, and sheet feeding apparatus for feeding sheets of printing stock into the printing press. The sheet feeding apparatus comprises at least a first surface over which sheets are moved, which sheets have a first surface for being disposed adjacent the first surface of the sheet feeding means and a second surface opposite to the first surface. The sheet alignment device comprises: a device for moving sheets a first distance in a direction substantially parallel to the longitudinal axis of the plate cylinder to laterally align sheets with respect to the plate cylinder, and the device for moving comprises, a first device for engaging the first surface of sheets being fed, the first device having a portion for engaging the first surface of sheets being fed, and the portion for engaging being configured to move in the direction substantially parallel to the longitudinal axis of the plate cylinder; and a roller device for engaging the second surface of sheets being fed and pressing the first surface of sheets being fed into engagement with the portion of the first device for movement of sheets along with the portion of the first device.

One further aspect of the invention resides broadly in a method for laterally aligning sheets of printing stock being fed into a printing press, the printing press having components as discussed above, and the method comprising the steps of: feeding sheets of printing stock into the printing press in a first direction towards the plate cylinder, and laterally moving ones of the sheets in a direction substantially offset from the first direction to substantially align ones of the sheets with a reference position. The step of laterally moving comprises engaging the first surface of ones of the sheets with the portion of the first device; pressing on the second surface of the ones of the sheets with the roller device to further engage the first surface of the ones of the sheets with the portion of the first device; and laterally displacing the portion of the first device in the direction offset from the first direction to move the ones of the sheets into the reference position.

BRIEF DESCRIPTION OF THE DRAWINGS

A specimen embodiment of the present invention is schematically illustrated in the accompanying drawings, in which.

DESCRIPTION OF THE PREFERRED EMBODIMENTS

Figure 1:
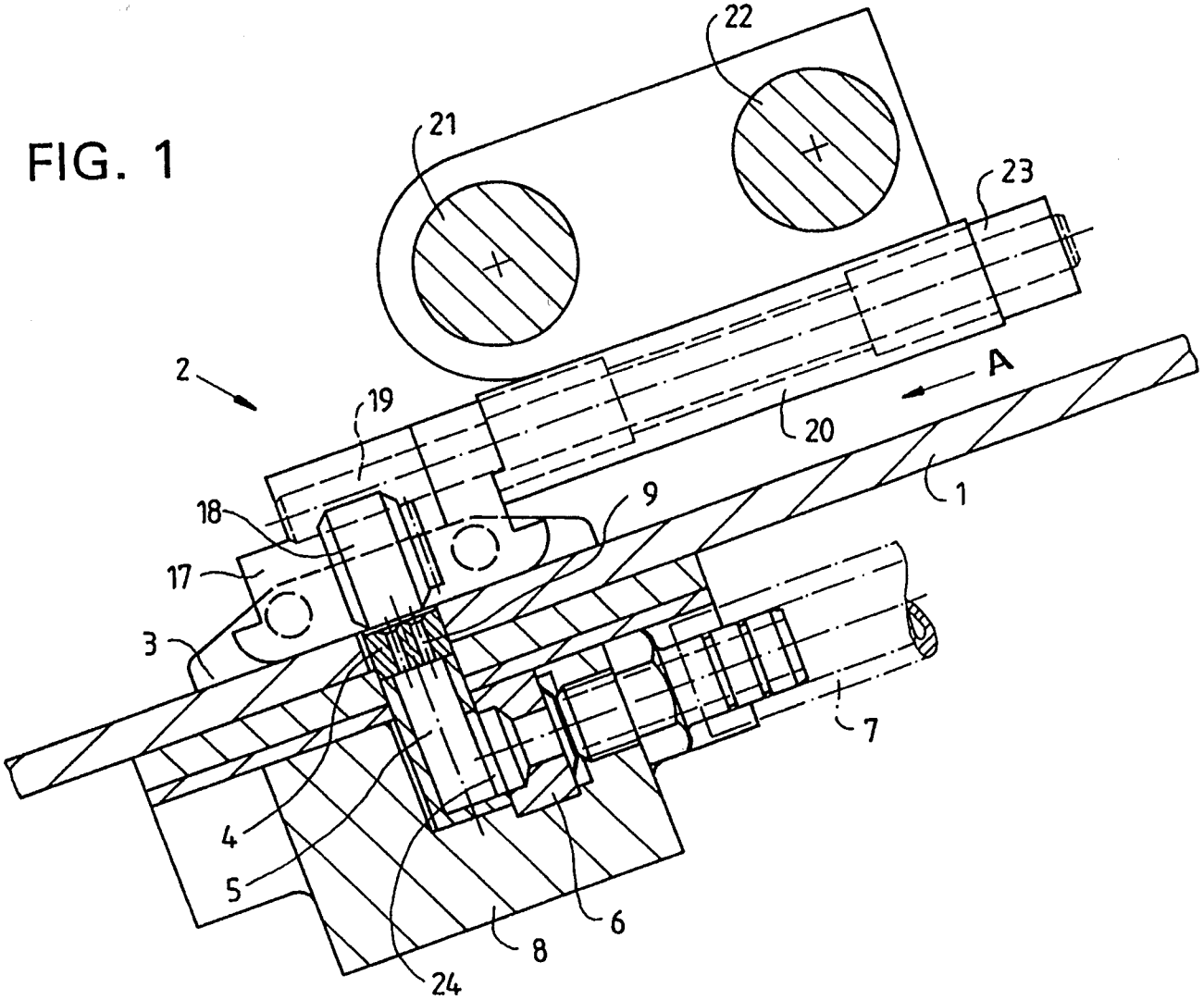
FIG. 1 is a longitudinal cut of a lateral alignment device taken in a direction of movement of the fed sheets.
Figure 1A:
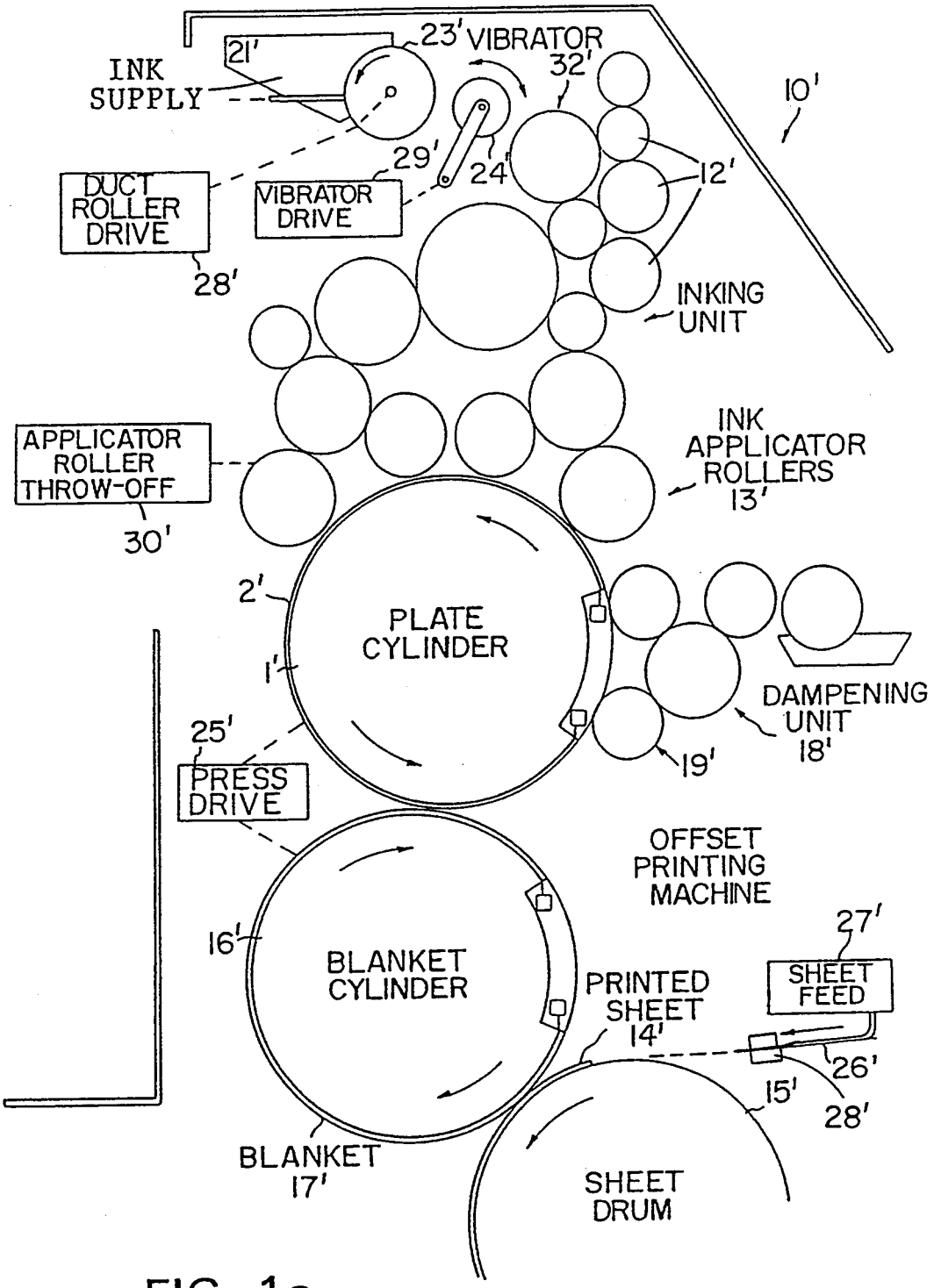
FIG. 1*a* is a schematic representation of a printing press.

In general, as shown in FIG. 1*a*, a printing press can have a print stand 10' which can provide a supporting framework for the internal components thereof. Such components of a printing press, depending on the type of printing press, can include a plate cylinder 1' for having mounted thereon a printing plate 2', and an inking unit for transferring ink to the plate cylinder 1'. The inking unit can essentially be considered to include an ink fountain 21', a duct roller 23' for picking up ink from the ink fountain 21', a vibrator roller 24' which oscillates to successively pick up ink from duct roller 23' and deposit the same on a roller 32', and a plurality of ink transfer rollers 12' for transferring the ink from the roller 32' to the ink applicator rollers 13'.

The printing press can also include a dampening (or wetting) unit 18' having dampening applicator rollers 19' for transferring a dampening agent to the printing plate 2'.

Once the printing plate 2' has been inked, the ink impression of the printing plate can preferably be applied to a rubber blanket 17' on a blanket cylinder 16'. The rubber blanket 17' can receive the ink impression from the printing plate 2', and can transfer the image to a sheet of printing stock 26' to produce a printed sheet 14'. This sheet of printing stock 26' can be supplied by means of a sheet drum 15', in conjunction with a sheet feed device 27' for supplying the sheets 26' to the press. In order that the printed image is correctly positioned on the sheets 26', the sheet feed device 27' can also include apparatus 28' for aligning the sheets 26' into a reference position before the sheets are fed into the printing unit. Such a sheet alignment apparatus is discussed in more detail herebelow.

Typically, the printing stand 10' can also include auxiliary mechanisms such as, for example, a duct roller drive 28', a vibrator roller drive 29', an applicator roller throw-off 30' for lifting the ink applicator rollers 13' off of the printing plate 2', and a press drive 25' for driving appropriate rollers, i.e. at least plate cylinder 1' and blanket cylinder 16'.

As indicated by an arrow A in FIG. 1, sheets to be aligned (not shown) can be fed, sheet-by-sheet, along the feeding table 1 to front stops (not illustrated), or into a forward position wherein the sheets can then be laterally aligned. After having been aligned at the front stops, a sheet can then be laterally aligned by moving the sheet laterally to abut a side lay 3. This lateral movement can be provided by means of a side-pull device 2.

For laterally moving the sheets to be aligned, the side-pull device 2 can preferably be provided with a side-pull rail 4 to which a suction is provided, and which rail 4 is connected to a suction chamber 5 to which the controlled suction can be supplied via a suction pipe 7, as illustrated in FIG. 1. The side-pull rail 4 can preferably be mounted in a traverse 8 so as to be longitudinally displaceable. The traverse 8, likewise, can be connected to a feeding table 1. By means of a laterally adjustable valve 6, the intake of fresh air can switch off, or reduce the suction effect provided by the side-pull rail 4. That is, suction pipe 7 can be substantially aligned with an opening 24 in a first lateral position of the side-pull rail 4, while upon movement of the side-pull rail 4 from the first lateral position, the suction opening in the rail 4 can move out of alignment with the suction pipe 7 and thereby open into a fresh air source, either partially, or even completely, thereby reducing, or even shutting off the suction being provided through the side-pull rail 4, as the air pulled through the suction pipe 7 can then essentially be air from the fresh air source, and not from the slide rail 4.

Figure 2:
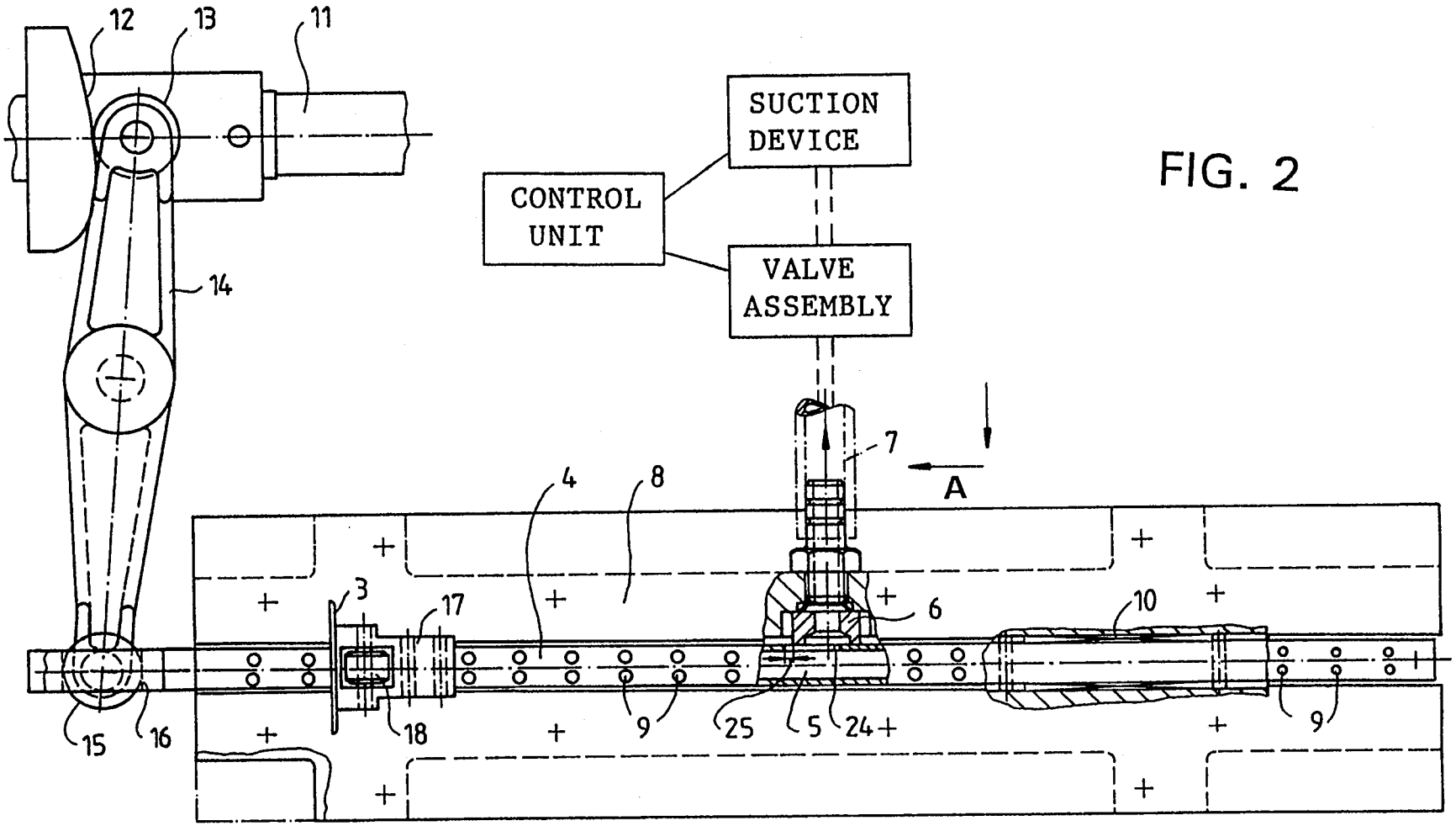
FIG. 2 is a top view of the lateral alignment device.

As shown in FIG. 2, the side-pull rail 4 can preferably be provided with a number of suction openings 9. The sheets to be aligned can then be suctioned against the side-pull rail 4 for movement of the sheets along with a movement of the side-pull rail 4. The side-pull rail 4 can be mounted in the traverse 8 by means of a sliding or antifriction bearing 10 so as to be longitudinally displaceable with respect to the table 1. The drive for moving the side-pull rail 4 is effected via a cam disk 12 mounted on a driven shaft 11, and a cam roller mounted on a pivotable lever 14. This lever 14 can essentially be pivot-mounted on the machine side frame. On the side of the lever 14 opposite the cam roller 13, there can preferably be a further roller 15 that engages a recess 16 provided in the side-pull rail 4. As the shaft 1 is driven, the cam disk 12 can actuate, or pivot the lever 14, and the pivoting movement of the lever 14 can then provide the lateral movement of the side-pull rail 4.

Figure 1B:
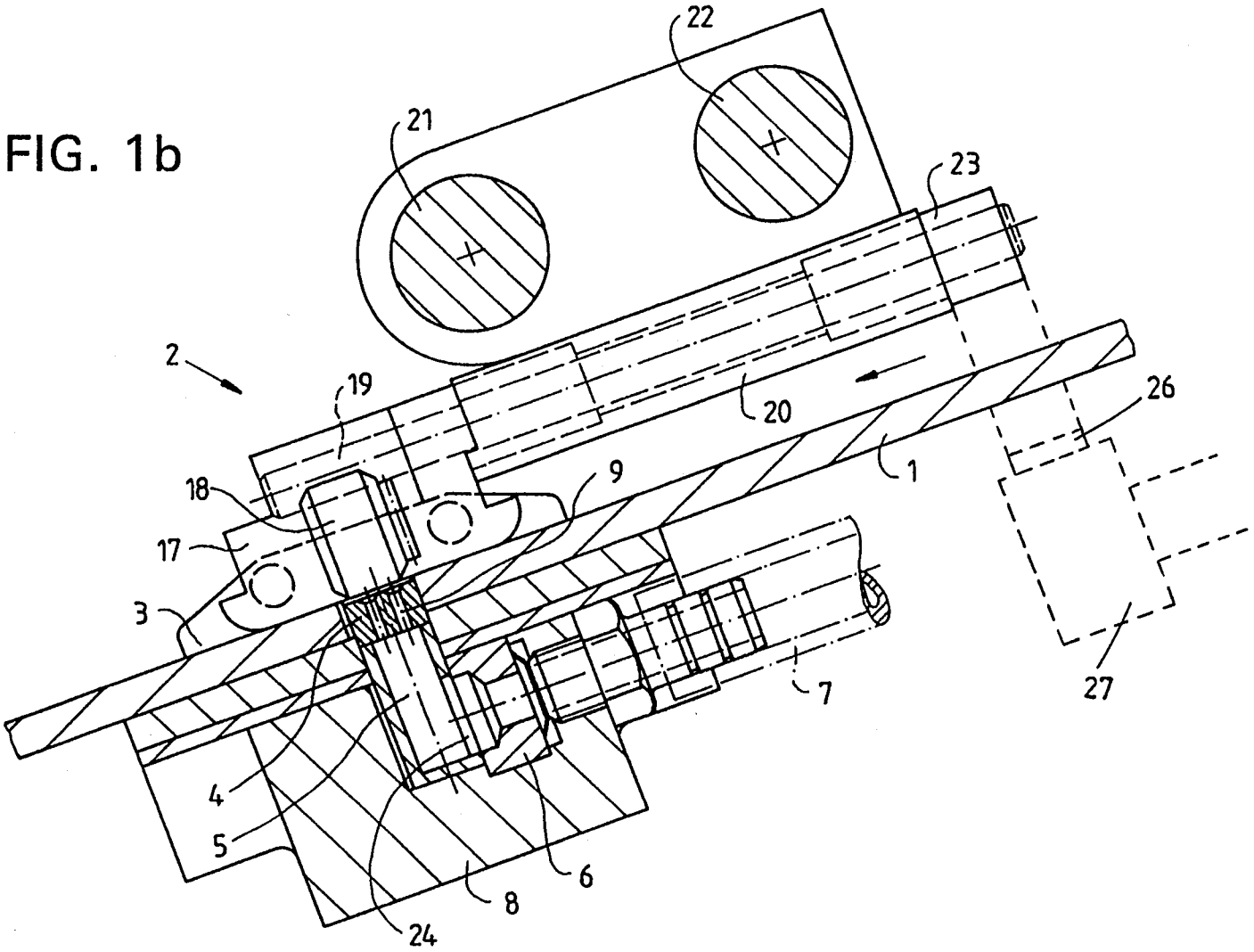
FIG. 1*b* shows an additional embodiment of the lateral alignment device with a cam for pivoting the pull roller.

The side lay 3 can preferably be fastened to a mounting support 17. The pull roller 18 can also preferably be mounted to the support 17 in a manner which enables the roller 18 to be rotatable about an axis of rotation. The mounting support 17 can be attached to a journal 19 which can be mounted in a bearing 20 so as to be rotatable within the bearing 20. The bearing 20, in turn, can be fastened to two traverses 21, 22 so as to be laterally displaceable to thereby allow for position adjustment of the lay 3 for different size sheets. Via a lever 23, a cam follower 26 and a cam 27 (illustrated in outline on FIG. 1*b*), the journal 19 can be rotated within the bearing 20 to control the mounting support 17 and the pull roller 18 so that the pull roller 18 may be placed into contact with the sheet to be laterally aligned. At the same time that the pull roller 18 is being pivoted into contact with the sheet, the side lay 3 can preferably also be swivelled into its guide position, or position to which the sheet will be moved to abut against the side lay 3.

For the lateral alignment of a respective sheet, the side-pull rail 4 is moved to the left as shown in FIG. 2. By means of control valves (not illustrated) which are provided in the suction pipe 7, the suction air can be switched on, and at the same time, the pull roller 18 can be placed into contact with the sheet to be aligned so that the sheet is preferably pressed onto the side pull-type rail 4. At the same time, the side lay 3 can be swivelled into the aligning position as discussed above. In other words, after a sheet is moved to its forward-most position on the table 1, three actions can preferably occur substantially simultaneously, the side lay 3 can be moved into position, the pull roller 18 can be positioned to press the sheet into contact with the pull-rail 4, and the suction can be turned on.

A short time later, after the sheet has been accelerated, and just before the sheet abuts against the side lay 3, the suction effect can preferably be switched off or reduced by means of the valve 6. The suction effect may, for example, be reduced, or switched off, respectively, as the opening 24, provided in the suction chamber 5, is displaced away from the suction pipe 7 while the side-pull rail 4 is displaced to the left, which displacement causes the opening 24 to first extend slightly beyond the valve 6 to thereby permit a small flow of fresh air to enter the suction chamber 5 through the gap 25 formed to the exterior of the valve 6 and thereby reduce the suction at the openings, and then later after further displacement can permit a substantial flow of fresh air to essentially cut off the suction at the openings. Also, by laterally displacing the valve 6 the negative pressure can be reduced or totally removed.

After the vacuum is switched off or reduced, the sheet is then transported in the lateral direction by means of the side-pull rails 4, and the pull roller 18 cooperating with the pull rail 4 to hold the sheet into engagement with the pull rail 4. As soon as the sheet abuts against the side lay 3, the pull roller 18 can preferably be swivelled away and the lateral movement of the pull rail 4 can preferably be stopped. With the pull roller 18 swivelled away, the sheet can then be freed to be further transported into the printing press in a forward direction of travel.

Then, subsequent to the forward movement of the laterally aligned sheet, and before the arrival of the next sheet to be aligned, the side-pull rail 4 can be moved back to the right and into its original position. To provide this return movement, the cam disk 12 can be designed correspondingly.

Furthermore, the time available for admitting suction air may be changed and the suction effect of the suction air, with respect to its intensity, may be adapted by means of the control valves, not shown, to correspond to a respective sheet type. Such controllable valves provided in the suction pipe 7 are state of the art and can be purchased on the market. Also, for processing light sheet material, it can be preferable to disengage the pull roller 18 so that the sheet may be laterally aligned merely by the suction effect without the contact of the pull roller 18.

One feature of the invention resides broadly in the device for laterally aligning sheets in a printing machine comprising a feeding table via which the sheets are stream-fed to front lays, and comprising a side pull-type device which laterally moves the sheets having been aligned at the front lays, by admitting suction air to said sheets, characterized in that said side pull-type device 2 features a side pull-type rail 4 to which the suction air is admitted, and a pull roll 18 pressing a respective sheet onto said side pull-type rail 4, that the suction air is switched on, when the pull roll 18 comes into contact with the sheet to be aligned, and that the sheet is moved against a side lay 3, and that via a valve 6 the suction effect is switched off/reduced after having laterally accelerated the sheet and before said sheet abuts against said side lay 3.

Another feature of the invention resides broadly in the device, characterized in that the time required for admitting suction-air and/or the intensity of the suction effect are adjustable according to the weight of the sheet to be processed.

Additional types of side-pull devices for laterally aligning sheets are disclosed by the following U.S. Pat. U.S. Pat. No. 4,533,134 to Galster, entitled "Mechanism for the Lateral Alignment of Sheets in a Printing Machine"; U.S. Pat. No. 4,451,029 to Wildmann and Melzer, entitled "Arrangement for Lateral Alignment of Sheets"; U.S. Pat. No. 4,330,117 to Weisbach, entitled "Method and Device for Aligning Sheets to be Printed in a Press"; U.S. Pat. No. 4,264,068 to Melzer, entitled "Mechanism for the Lateral Alignment of Sheets on Feed Table"; U.S. Pat. No. 4,257,586 to Weisbach, entitled "Method and Device for Aligning Sheets to be Printed in a Press"; and U.S. Pat. No. 4,184,673 to Weisbach, entitled "Method of and an Apparatus for Aligning Sheets Advancing in an Overlapping Array to a Printing Machine".

All, or substantially all, of the components and methods of the various embodiments may be used with at least one embodiment or all of the embodiments, if any, described herein.

All of the patents, patent applications and publications recited herein, and in the Declaration attached hereto, are hereby incorporated by reference as if set forth in their entirely herein.

The corresponding foreign patent publication applications, namely, Federal Republic of Germany Patent Application No. P 42 42 731, filed on Dec. 17, 1992, having inventor Gerhard Pollich, and DE-OS P 42 42 731 and DE-PS P 42 42 731, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

LIST OF REFERENCE NUMERALS

1 feeding table
2 side-pull device
3 side lay
4 side-pull rail
5 suction chamber
6 valve
7 suction pipe
8 traverse
9 suction opening
10 antifriction bearing
11 shaft
12 cam disk
13 cam roller
14 lever
15 roller
16 recess
17 mounting support
18 pull roller
19 journal
20 bearing
21 traverse
22 traverse
23 lever
24 opening
25 gap
26 cam follower
27 cam

What is claimed is:

1. A method for laterally aligning sheets of printing stock being fed into a printing press, the printing press having a frame, a plate cylinder rotatably mounted on the frame, the plate cylinder having a longitudinal axis and a printing width along the longitudinal axis, and sheet feeding means for feeding sheets of printing stock into the printing press, the sheet feeding means comprising at least a first surface over which sheets are moved, which sheets have a first surface for being disposed adjacent the first surface of the sheet feeding means and a second surface opposite to the first surface, said sheet alignment device comprises means for moving sheets a first distance in a direction substantially parallel to the longitudinal axis of the plate cylinder to laterally align sheets with respect to the plate cylinder, said means for moving comprising: a first device for engaging the first surface of sheets being fed, said first device having a portion for engaging the first surface of sheets being fed, said portion for engaging being configured to move in said direction substantially parallel to the longitudinal axis of the plate cylinder, and said portion for engaging of said first device comprises a surface having openings therein; suction means for providing suction at said openings to hold the first surface of sheets in contact with said portion for engaging of said first device for at least assisting movement of sheets with said portion for engaging; and roller means for engaging the second surface of sheets being fed and pressing the first surface of sheets being fed into engagement with said portion for engaging of said first device for at least assisting movement of sheets along with said portion for engaging of said first device, and said method comprises the steps of:

feeding sheets of printing stock into the printing press in a first direction towards said plate cylinder;

laterally moving ones of the sheets in a direction substantially offset from said first direction to substantially align ones of the sheets with a reference position;

said laterally moving comprising:

engaging the first surface of ones of said sheets with said portion of said first device, said engaging comprising:

applying a suction through said openings of said portion for engaging of said first device to suction said ones of said sheets into engagement with said portion for engaging of said first device to hold said ones of said sheets to said portion for engaging during said lateral displacement of said portion of said first device; and pressing on said second surface of said ones of said sheets with said roller means to further engage the first surface of said ones of said sheets with said portion for engaging of said first device; and laterally displacing said portion for engaging of said first device in said direction offset from said first direction to move said ones of said sheets into said reference position.

2. The method according to claim 1, wherein said device further comprises means for pivoting said roller means into engagement with the second surface of said ones of said sheets, means for switching on said suction means, and means for releasing at least part of said suction upon the sheet having been moved a portion of said first distance, and said method further comprises the steps of:

pivoting said roller means into engagement with the second surface of said ones of said sheets;

substantially simultaneously with said pivoting switching on said suction means to apply said suction to said ones of said sheets;

moving said ones of said sheets in said direction substantialy offset from said first direction; and releasing at least a portion of said suction after moving said ones of said sheets at least a portion of said first distance while maintaining engagement of said roller means with said ones of said sheets to hold said ones of said sheets into engagement with said portion of said first device.

3. The method according to claim 2, further including:

laterally accelerating said ones of said sheets engaged between said roller means and said portion of said first device and suctioned to said portion of said first device from a substantially zero lateral velocity to a lateral velocity of movement; and releasing said lat least portion of said suction upon said ones of said sheets having been laterally accelerated to said velocity of movement.

4. The method according to claim 3, wherein said first device comprises rail means slidably disposed in said first surface of said feeding means in a direction substantially parallel to the longitudinal axis of the plate cylinder, said aligning device further comprises a side lay for providing said reference position, and said method further comprises the step of:

pivoting said roller means along with said side lay towards and away from said rail means.

5. The method according to claim 4, wherein:

said feeding comprises feeding said ones of said sheets in a sheet-by-sheet manner into said printing press in a substantially continuous stream of said ones of said sheets;

said method further comprises feeding said ones of said sheets to said rail means at a first position of said rail means and feeding said ones of said sheets away from said rail means at a second position laterally displaced with respect to said first position;

said rail means comprises a hollow bar for connecting said openings therein with said suction means, and said method further comprises applying the suction through said openings via the hollow bar comprising said rail means;

said suction means comprises a first valve means disposed adjacent said rail means, a vacuum unit for producing a vacuum, and hose means connecting said vacuum unit to said valve means adjacent said rail means;

said first valve means comprises an opening disposed adjacent said rail means;

said rail means comprise one additional opening for being substantially aligned with said opening of said valve means, and said method further comprises the steps of:

aligning said additional opening of said rail means with said opening of said valve means in said first position of said rail means to provide substantially full suction through said opening of said rail means;

providing substantially full suction through said aligned openings;

laterally displacing said rail means from said first position towards said second position to displace said rail means past said valve means and thereby displace said additional opening of said rail means away from said opening of said valve means;

displacing at least a portion of said additional opening of said rail means beyond beyond said valve means to open beyond said valve means and provide a suction bypass of said opening of said rail means; and suctioning fresh air through said bypass to thereby at least reduce suction through openings of said rail means;

said aligning device further comprises means for laterally moving said rail means in said direction substantially parallel to the longitudinal axis of the plate cylinder, said means for moving comprises a pivoting lever, said pivoting lever having a central portion, and said pivoting lever being pitovably mounted to said frame in said central portion of said lever, said pivoting lever having a first end and a second end opposite to said first end, said rail means comprises a slot for receiving said first end of said pivoting lever, said second end of said pivoting lever comprises cam follower means, said means for moving further comprises a rotating rod disposed adjacent said second end of said pivoting lever, said rotating rod comprising cam means disposed thereabout, and said cam means being configured to guide said cam follower means to pivot said pivoting lever and move said rod means in said direction parallel to the longitudinal axis of the plate cylinder, said method further comprising:

rotating said rotating rod to move said cam means past said cam follower means;

following said cam with said cam follower to pivot said pivoting lever and displace said first end of said pivoting lever in a direction substantially parallel to the longitudinal axis of said plate cylinder; and pulling said rail means from said first position to said second position;

said aligning device further comprises additional bar means disposed substantially parallel to the longitudinal axis, with guide means disposed on said additional bar means for movement along said additional bar means and pivot means for for pivoting said side lay and said roller means towards and away from said rail means disposed on said guide means, said means for pivoting comprising a first bearing attached to said guide means, and a journal rod disposed within said bearing to rotate within said bearing, said journal rod having a first end and a second end opposite to said first end, with said side lay and said roller means being attached to saif first end of said journal rod; and said second end of said journal rod comprising lever means for rotating said journal rod within said bearing to pivot said side lay and said roller means towards and away from said rod means, and said method further comprises:

sliding said guide means along said additional bar means to relatively position said side lay to said reference position;

pivoting said lever means to pivot said journal rod within said bearing; and moving said side lay and said roller means towards and away from said rail means by said pivoting of said journal rod;

said suction means comprises control valves for adjusting a suction force applied to sheets through said openings of said rod means, said aligning device further comprises control means for controlling said switch means and said valve means to vary a suction time and allow for adjustment of said suction force as a function of the weight of sheets being fed, and said method further comprises:

adjusting said suction force and said suction time as a function of said sheets being fed.

6. A Printing press comprising:

a frame;

a plate cylinder rotatably mounted on said frame, the plate cylinder having a longitudinal axis and a printing width along the longitudinal axis;

a plurality of ink applicator rollers for being engaged with said plate cylinder and for applying ink to said plate cylinder;

a plurality of inking roller for applying ink to said plurality of ink applicator rollers;

said plate cylinder having a printing width for accommodating ink, and said plurality of inking rollers having an inkable width corresponding to the printing width of said plate cylinders;

means for supplying ink to said plurality of inking rollers;

sheet feeding means for feeding sheets of printing stock into said printing press, said sheet feeding means comprising at least a first surface over which sheets are moved, which sheets have a first surface for being disposed adjacent said first surface of said sheet feeding means and a second surface opposite to said first surface; and means for moving sheets a first distance in a direction substantially parallel to the longitudinal axis of said plate cylinder to laterally align sheets with respect to said plate cylinder;

said means for moving comprising:

a first device for engaging the first surface of sheets being fed, said first device having a portion for engaging the first surface of sheets being fed, said portion for engaging being configured to move in said direction substantially parallel to said longitudinal axis of said plate cylinder, and said portion for engaging comprises a surface having openings therein;

suction means for providing suction at said openings to hold the first surface of sheets in contact with said portion for engaging of said first device for at least assisting movement of sheets along with said portion for engaging of first device; and roller means for engaging the second surface of sheets being fed and pressing the first surface of sheets being fed into engagement with said portion for engaging of said first device for at least assisting movement of sheets along with said portion for engaging of first device;

said roller means being pivotable towards said first device to engage a sheet between said first device and said roller means, and away from said first device to release a sheet from engagement between said roller means and said first device; and said printing press further comprises:

switch means for switching on said suction means upon said roller means being pivoted into engagement with a sheet; and means for releasing at least part of said suction upon the sheet having been moved at least a portion of said first distance.

7. The printing press according to claim 6, wherein:

said means for moving is configured to laterally accelerate sheets upon engagement of a sheet between said roller means and said first device from a substantially zero lateral velocity to a lateral velocity of movement; and said means for releasing at least part of said suction is configured for releasing said at least part of said suction upon a sheet having been laterally accelerated to said velocity of movement.

8. The printing press according to claim 7, wherein:

said first device comprises rail means slidably disposed in said first surface of said feeding means in a direction substantially parallel to said longitudinal axis of said plate cylinder;

said printing press further comprises a side lay for providing a lateral sheet reference position with respect to said plate cylinder; and said roller means is connected to said side lay for pivoting along with said side lay towards and away from said first device.

9. The printing press according to claim 8, wherein:

said rail means has a first position for receiving sheets and a second position laterally displaced with respect to said first position for aligning sheets adjacent said side lay;

said rail means comprises a hollow bar for connecting said openings therein with said suction means;

said suction means comprises:

a first valve means disposed adjacent said rail means;

a vacuum unit for producing a vacuum; and hose means connecting said vacuum unit to said valve means adjacent said rail means;

said first valve means comprising an opening disposed adjacent said rail means;

said rail means comprise one additional opening for being substantially aligned with said opening of said valve means in said first position of said rail means to provide substantially full sunction through said opening of said rail means;

said rail means being configured to slide past said opening of said valve means during lateral movement of said rail means from said first position towards said second position to displace said one additional opening of said rail means away from said opening of said valve means; and said rail means comprises a third position between said first position and said second position wherein said one additional opening extends beyond said valve means to open beyond said valve means and allow suction bypass of said openings of said rail means thereby at least reducing suction through said openings of said rail means.

10. The printing press according to claim 9, wherein:

said printing press further comprises means for laterally moving said rail means in said direction substantially parallel to said longitudinal axis of said plate cylinder;

said means for moving comprises a pivoting lever, said pivoting lever having a central portion, and said pivoting lever being pivotably mounted to said frame in said central portion of said lever;

said pivoting lever having a first end and a second end opposite to said first end;

said rail means comprises a slot for receiving said first end of said pivoting lever;

said second end of said pivoting lever comprises cam follower means;

said meand for moving further comprises a rotating rod disposed adjacent said second end of said pivoting lever, said rotating rod comprising cam means disposed thereabout;

said cam means being configured to guide said cam follower means to pivot said pivoting lever and move said rod means in said direction parallel to said longitudinal axis of said plate cylinder;

said printing press further comprises:

additional bar means disposed substantially parallel to said longitudinal axis;

guide means disposed on said additional bar means for movement along said additional bar means;

means for pivoting said side lay and said roller means towards and away from said rail means;

said means for pivoting being fastened to said guide means for movement along said additional bar means to allow for said side lay to be variably positioned with respect to said plate cylinder;

said means for pivoting comprising a first bearing attached to said guide means;

a journal rod disposed within said bearing to rotate within said bearing, said journal rod having a first end and a second end opposite to said first end;

said side lay and said roller means being attached to said first end of said journal rod;

said second end of said journal rod comprises lever means for rotating said journal rod within said bearing to pivot said side lay and said roller means towards and away from said rod means;

said additional rod means comprise two parallel rods for providing parallel movement of said guide means in said direction parallel to said longitudinal axis;

said first surface comprises bearing means disposed therein for guiding said lateral movement of said rod means within said first surface;

said suction means comprises control valves for adjusting a suction force applied to sheets thorugh said openings of said rod means;

said printing press further comprises control means for controlling said switch means and said valve means to vary a suction time and allow for adjustment of said suction force as a function of the weight of sheets being fed;

said sheet feeding means is configured to feed sheets in a sheet-by-sheet manner in a substantially continuous manner into the printing press;

said first surface comprises forward stops for interrupting movement of sheets into the printing press;

said means for moving being configured to laterally move sheets upon sheets contacting said forward stops; and said sheet feeding means being configured to continue moving laterally aligned sheets in said direction into said printing press after said lateral alignment is done.

11. A sheet alignment device for aligning sheets of printing stock being fed into a printing press, the printing press having a frame, a plate cylinder rotatably mounted on the frame, the plate cylinder having a longitudinal axis and a printing width along the longitudinal axis, and sheet feeding means for feeding sheets of printing stock into the printing press, the sheet feeding means comprising at least a first surface over which sheets are moved, which sheets have a first surface for being disposed adjacent the first surface of the sheet feeding means and a second surface opposite to the first surface; and said sheet alignment device comprising:

means for moving sheets in a direction substantially parallel to the longitudinal axis of the plate cylinder for laterally aligning sheets with respect to the plate cylinder;

said means for moving comprising:

a first device for engaging the first surface of sheets being fed, said first device having a portion for engaging the first surface of sheets being fed, said portion for engaging being configured to move in said direction substantially parallel to the longitudinal axis of the plate cylinder, said portion for engaging comprises a surface having openings therein;

suction means for providing suction at said openings to hold the first surface of sheets in contact with said portion for engaging of said first device for at least assisting movement of sheets along with said portion for engaging of said first device; and roller means for engaging the second surface of sheets being fed and pressing the first surface of sheets being fed into engagement with said portion for engaging of said first device for movement of sheets along with said portion for engaging of said first device.

12. The aligning device according to claim 11, further including:

means for pivoting said roller means towards said first device to engage a sheet between said first device and said roller means, and away from said first device to release a sheet from engagement between said roller means and said first device;

means for switching on said suction means to suction a sheet into engagement with said portion for engaging; and means for at least partially releasing the suction between a sheet and said portion for engaging.

13. The aligning device according to claim 12, wherein said means for moving moves sheets being aligned a first distance in the direction substantially parallel to the longitudinal axis of the plate cylinder, and said device further comprises:

said means for switching on said suction means comprising switch means for switching on said suction means upon pivoting of said roller means into engagement with a sheet; and said means for at least partially releasing the suction comprising means for releasing at least part of the suction upon the sheet having been moved at least a portion of the first distance.

14. The aligning device according to claim 13, wherein:

said means for moving is configured to laterally accelerate sheets upon engagement of a sheet between said roller means and said first device from a substantially zero lateral velocity to a lateral velocity of movement; and said means for releasing at least part of said suction is configured for releasing said at least part of said suction upon a sheet having been laterally accelerated to said velocity of movement.

15. The aligning device according to claim 14, wherein:

said first device comprises rail means slidably disposed in said first surface of said feeding means in a direction substantially parallel to the longitudinal axis of the plate cylinder;

said aligning device further comprises a side lay for providing a lateral sheet reference position with respect to the plate cylinder; and said roller means is connected to said side lay for pivoting along with said side lay towards and away from said first device.

16. The aligning device according to claim 15, wherein:

said rail means has a first position for receiving sheets and a second position laterally displaced with respect to said first position for aligning sheets adjacent said side lay;

said rail means comprises a hollow bar for connecting said openings therein with said suction means;

said suction means comprises:

a first valve means disposed adjacent said rail means;

a vacuum unit for producing a vacuum; and hose means connecting said vacuum unit to said valve means adjacent said rail means;

said first valve means comprises an opening disposed adjacent said rail means;

said rail means comprise one additional opening for being substantially aligned with said opening of said valve means in said first position of said rail means to provide substantially full suction through said opening of said rail means;

said rail means being configured to slide past said opening of said valve means during lateral movement of said rail means from said first position towards said second position to displace said one additional opening of said rail means away from said opening of said valve means; and said rail means comprises a third position between said first position and said second position wherein said one additional opening extends beyond said valve means to open beyond said valve means and allow suction bypass of said openings of said rail means thereby at least reducing suction through said openings of said rail means.

17. The aligning device according to claim 16, wherein:

said aligning device further comprises means for laterally moving said rail means in said direction substantially parallel to the longitudinal axis of the plate cylinder;

said means for moving comprises a pivoting lever, said pivoting lever having a central portion, and said pivoting lever being pivotably mounted to said frame in said central portion of said lever;

said pivoting lever having a first end and a second end opposite to said first end;

said rail means comprises a slot for receiving said first end of said pivoting lever;

said second end of said pivoting lever comprises cam follower means;

said means for moving further comprises a rotating rod disposed adjacent said second end of said pivoting lever, said rotating rod comprising cam means disposed thereabout;

said cam means being configured to guide said cam follower means to pivot said pivoting lever and move said rod means in said direction parallel to the longitudinal axis of the plate cylinder;

said aligning device further comprises:

additional bar means disposed substantially parallel to the longitudinal axis;

guide means disposed on said additional bar means for movement along said additional bar means;

means for pivoting said side lay and said roller means towards and away from said rail means;

said means for pivoting being fastened to said guide means for movement along said additional bar means to allow for said side lay to be variably positioned with respect to said plate cylinder;

said means for pivoting comprising a first bearing attached to said guide means;

a journal rod disposed within said bearing to rotate within said bearing, said journal rod having a first end and a second end opposite to said first end;

said side lay and said roller means being attached to said first end of said journal rod;

said second end of said journal rod comprises lever means for rotating said journal rod within said bearing to pivot said side lay and said roller means towards and away from said rod means;

said additional rod means comprise two parallel rods for providing parallel movement of said guide means in said direction parallel to said longitudinal axis;

said aligning device further comprises bearing means disposed within said first surface for guiding said lateral movement of said rod means within said first surface;

said suction means comprises control valves for adjusting a suction force applied to sheets through said openings of said rod means;

said aligning device further comprises control means for controlling said switch means and said valve means to vary a suction time and allow for adjustment of said suction force as a function of the weight of sheets being fed;

said aligning device is configured to align sheets in a sheet-by-sheet manner in a substantially continuous manner;

said aligning device further comprises forward stops disposed on the first surface for interrupting movement of sheets into the printing press;

said means for moving being configured to laterally move said sheets upon said sheets contacting said forward stops; and said sheet feeding means being configured to continue moving said laterally aligned sheets in said direction into said printing press after said lateral alignment is done.

* * * * *

UNITED STATES PATENT AND TRADEMARK OFFICE

CERTIFICATE OF CORRECTION

PATENT NO. : 5.419.256

DATED : May 30, 1995

INVENTOR(S) : Gerhard POLLICH

It is certified that error appears in the above-indentified patent and that said Letters Patent is hereby corrected as shown below:

In Column 9, line 4, Claim 3, after 'said', first occurrence, delete "lat" and insert --at--.

In Column 10, line 37, Claim 5, after 'to' delete "saif" and insert --said--.

In Column 11, line 9, Claim 6, after 'plate' delete "cylinders;" and insert --cylinder;--.

In Column 12, line 56, Claim 10, after 'said' delete "meand" and insert --means--.

Signed and Sealed this

Sixteenth Day of July, 1996

*Attest:*

*Attesting Officer*

Bruce Lehman

BRUCE LEHMAN

*Commissioner of Patents and Trademarks*